US011139581B2

(12) United States Patent
Yao et al.

(10) Patent No.: US 11,139,581 B2
(45) Date of Patent: Oct. 5, 2021

(54) SIGNALING DEVICE INCLUDING A SLOT TRANSITION BETWEEN A SUBSTRATE INTEGRATED WAVEGUIDE AND A SIGNAL GENERATOR

(71) Applicant: Aptiv Technologies Limited, St. Michael (BB)

(72) Inventors: Jun Yao, Kokomo, IN (US); George J. Purden, Atascadero, CA (US); Ryan K. Rossiter, Kokomo, IN (US)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 82 days.

(21) Appl. No.: 16/295,285

(22) Filed: Mar. 7, 2019

(65) Prior Publication Data

US 2020/0287290 A1 Sep. 10, 2020

(51) Int. Cl.

| | |
|---|---|
| ***H01Q 1/38*** | (2006.01) |
| ***H01Q 13/18*** | (2006.01) |
| ***H01Q 1/50*** | (2006.01) |
| *H01Q 1/32* | (2006.01) |

(52) U.S. Cl.

CPC ..... *H01Q 13/18* (2013.01); *H01Q 1/38* (2013.01); *H01Q 1/50* (2013.01); *H01Q 1/3283* (2013.01)

(58) Field of Classification Search

CPC ..... H01Q 1/38; H01Q 1/50; H01Q 1/3233; H01Q 1/3283; H01Q 13/06; H01Q 13/10; H01Q 13/18; H01Q 13/106; H01Q 21/005; H01P 5/107; H01P 3/121

See application file for complete search history.

(56) References Cited

U.S. PATENT DOCUMENTS

| | | | | |
|---|---|---|---|---|
| 2012/0242427 | A1* | 9/2012 | Suzuki | H01P 5/107 333/250 |
| 2015/0333726 | A1 | 11/2015 | Xue et al. | |
| 2015/0364804 | A1* | 12/2015 | Tong | G01S 7/032 342/175 |
| 2018/0090848 | A1* | 3/2018 | Elsherbini | H01P 5/1007 |
| 2018/0108968 | A1* | 4/2018 | Purden | H01P 5/08 |
| 2019/0089042 | A1 | 3/2019 | Purden et al. | |

FOREIGN PATENT DOCUMENTS

| | | | |
|---|---|---|---|
| CA | 107946278 | A | 4/2018 |
| CN | 102780092 | A | 11/2012 |
| EP | 3309896 | A1 | 4/2018 |

(Continued)

OTHER PUBLICATIONS

Extended European Search Report for Application No. EP 18194839.9 dated Feb. 6, 2019.

(Continued)

*Primary Examiner* — Jimmy T Vu

(74) *Attorney, Agent, or Firm* — Carlson, Gaskey & Olds

(57) ABSTRACT

An illustrative example electronic device includes a signal generator having at least one conductive output member. A substrate integrated waveguide (SIW) includes a substrate and a plurality of conductive members in the substrate. The substrate includes a slot in one exterior surface of the substrate. The slot is situated adjacent the at least one conductive output member of the signal generator such that a signal of the signal generator is coupled into the SIW through the slot.

19 Claims, 2 Drawing Sheets

(56) References Cited

FOREIGN PATENT DOCUMENTS

| | | | |
|---|---|---|---|
| GB | 2 499 792 | A | 9/2013 |
| JP | H08 148913 | A | 6/1996 |
| JP | 2009033526 | A | 2/2009 |
| JP | 4854622 | B2 | 1/2012 |

OTHER PUBLICATIONS

Li Yujian, et al.: "60-GHz Dual-Polarized Two-Dimensional Switch-Beam Wideband Antenna Array of Aperture-Coupled Magneto-Electric Dipoles." Feb. 1, 2016, pp. 554-563.

Extended European Search Report for Application No. EP 20155297.3 dated Jun. 25, 2020.

F. Bauer and W. Menzel, "A wideband transition from substrate integrated waveguide to differential microstrip lines in multilayer substrates," in Proc. 40th Eur. Microw. Conf. (EuMC), Paris, France, Sep. 2010, pp. 811-813.

X. Wang and A. Stelzer, "A 79-GHz LTCC differential microstrip line to laminated waveguide transition using high permittivity material," in Proc. Asia-Pacific Microw. Conf., Dec. 2010, pp. 1593-1596.

K. Parmar and S. Singh,"50-60 GHz waveguide to microstrip transition on LTCC for enabling integrated MMIC pachaging," in Proc. Of International Microwave and RF Conference (IMaRC), New Delhi, India, Dec. 2016.

A. Zaman, V. Vassilev, H. Zirath and N. Rorsman, "Novel Low-Loss Millimeter-Wave Transition From Waveguide-to-Microstrip Line Suitable for MMIC Integration and Packaging," Microwave and Wireless Components Letters, IEEE, vol. 27, Dec. 2017.

Y. Shi, J. Zhang, S. Zeng and M. Zhou,"Novel W-band Millimeter Wave Transition From Microstrip Line to Groove Gap Waveguide for MMIC Integration and Antenna Application," Antennas and Propagation, IEEE Transactions on Mar. 2018.

Notice of the First Office Action, CN Application No. 202010156272.6 dated Apr. 22, 2021.

* cited by examiner

SIGNALING DEVICE INCLUDING A SLOT TRANSITION BETWEEN A SUBSTRATE INTEGRATED WAVEGUIDE AND A SIGNAL GENERATOR

BACKGROUND

Modern day passenger vehicles include an increasing amount of electronics. Advances in technology have made it possible to incorporate a wide variety of systems onto a vehicle. For example, various sensor configurations have been developed to provide assistance or information to a driver regarding the environment surrounding the vehicle. Various object detection and sensing technologies provide parking assist and collision avoidance features, for example.

Advances in radio frequency signaling technology have enabled the development of sophisticated system-on-a-chip integrated circuits. The functionality required for environmental sensing or communications can be embodied in integrated circuit components. Monolithic microwave integrated circuits (MMICs), for example, operate at a microwave frequency and can be used for generating radar detection signals.

Various antennas useful for automotive radar systems are known, including, for example, a substrate-integrated-wave guide (SIW). These devices are useful in the vehicle context because they typically possess high efficiency and are relatively low cost. One challenge associated with utilizing SIWs for a vehicle-based sensing or communication system is associated with the connection between the signal generating integrated circuit components and the SIW. For example, microstrip or coplanar wave guide microwave transmission lines can provide an interface between the integrated circuit components and the SIW. Such connections include drawbacks, such as the requirement for a microwave component that matches the field configuration peculiar to each transmission line. The transition associated with such a microwave component increases microwave loss and introduces microwave reflections that may limit bandwidth and impact the ability to produce such systems. When a microstrip is used, bandwidth may be limited by the requirement for the ground connection to pass from the integrated circuit component connectors through the SIW substrate to a metal layer on that substrate. Such connections are typically made using a relatively expensive blind via process.

SUMMARY

An illustrative example electronic device includes a signal generator having at least one conductive output member. A substrate integrated waveguide (SIW) includes a substrate and a plurality of conductive members in the substrate. The substrate includes a slot in one exterior surface of the substrate. The slot is situated adjacent to the at least one conductive output member of the signal generator such that a signal of the signal generator is coupled into the SIW through the slot.

In an example embodiment having one or more features of the device of the previous paragraph, the at least one conductive output member comprises two output members and a portion of the slot is situated between the two output members.

In an example embodiment having one or more features of the device of any of the previous paragraphs, the signal of the signal generator comprises a differential signal.

In an example embodiment having one or more features of the device of any of the previous paragraphs, the two output members respectively comprise a solder ball.

In an example embodiment having one or more features of the device of any of the previous paragraphs, the SIW has a length that corresponds to a direction of signal propagation along the SIW, the slot has a length that is parallel to the SIW length, and the length of the slot corresponds to one-half a wavelength of a signal produced by the signal generator.

In an example embodiment having one or more features of the device of any of the previous paragraphs, the substrate includes a second slot near one end of the slot and the second slot is transverse to the slot.

In an example embodiment having one or more features of the device of any of the previous paragraphs, the second slot is perpendicular to the slot.

In an example embodiment having one or more features of the device of any of the previous paragraphs, the at least one conductive output member is between the second slot and another end of the slot.

In an example embodiment having one or more features of the device of any of the previous paragraphs, the at least one conductive output member comprises two output members, the second slot has a length, and the length of the second slot is at least as long as a center-to-center spacing between the two output members.

An example embodiment having one or more features of the device of any of the previous paragraphs includes a stub near an end of the slot, the stub having a stub width that is wider than a width of the slot and a stub length that is shorter than a length of the slot.

In an example embodiment having one or more features of the device of any of the previous paragraphs, the slot and the stub comprise openings through the exterior surface of the substrate.

In an example embodiment having one or more features of the device of any of the previous paragraphs, the exterior surface of the substrate comprises an electrically conductive metal.

In an example embodiment having one or more features of the device of any of the previous paragraphs, the exterior surface includes a transverse slot near a first end of the slot, the exterior surface includes a stub near a second end of the slot, the at least one conductive output member is closer to the first end of the slot than the second end of the slot, and the transverse slot is situated on an opposite side of the at least one conductive output member from the stub.

In an example embodiment having one or more features of the device of any of the previous paragraphs, the at least one conductive output member comprises two output members, the two output members have a spacing between them, a portion of the slot is situated within the spacing between the two output members.

In an example embodiment having one or more features of the device of any of the previous paragraphs, a width of the slot is less than the spacing.

An illustrative example method of making an electronic device includes: forming a slot in an exterior surface of a substrate, the substrate including a plurality of conductive members, the substrate and the plurality of conductive members establishing a substrate integrated waveguide (SIW); and placing a signal generator adjacent the exterior surface of the substrate near the slot, the signal generator having at least one conductive output member situated adjacent the slot such that a signal of the signal generator is coupled into the SIW through the slot.

In an example embodiment having one or more features of the method of the previous paragraph, forming the slot comprises etching a metal layer on the exterior surface of the substrate.

An example embodiment having one or more features of the method of any of the previous paragraphs includes forming a transverse slot near one end of the slot and forming a stub near an opposite end of the slot.

In an example embodiment having one or more features of the method of any of the previous paragraphs, the signal of the signal generator has a wavelength and forming the slot includes establishing a length of the slot that corresponds to one-half of the wavelength.

In an example embodiment having one or more features of the method of any of the previous paragraphs, the at least one conductive output member comprises two output members, the two output members have a spacing between them, and placing the signal generator adjacent the exterior surface of the substrate includes situating a portion of the slot within the spacing between the two output members.

The various features and advantages of at least one disclosed example embodiment will become apparent to those skilled in the art from the following detailed description. The drawings that accompany the detailed description can be briefly described as follows.

DETAILED DESCRIPTION

Embodiments of this invention provide a signaling device having a unique connection between a signal generator output and a substrate-integrated-waveguide (SIW). Embodiments of this invention eliminate interconnecting transitions between the signal generator and the SIW, which maximizes system performance while minimizing complexity.

Figure 1:
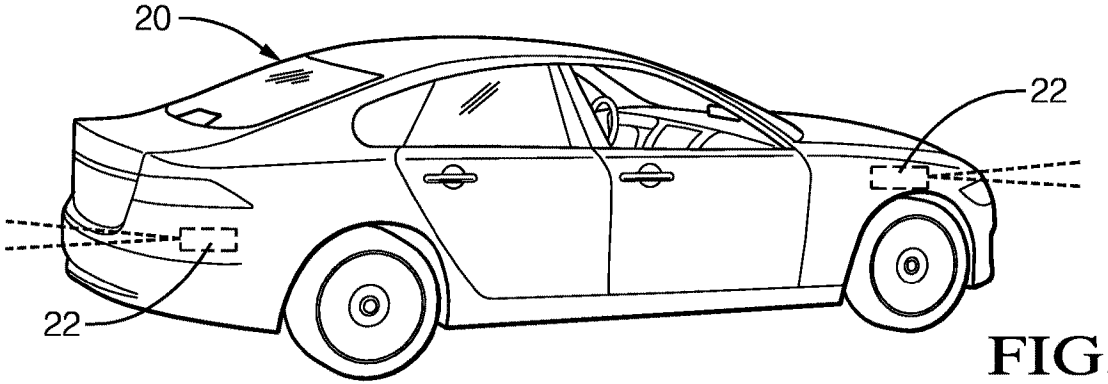
FIG. 1 diagrammatically illustrates a vehicle including a signaling device designed according to an embodiment of this invention.

FIG. 1 illustrates a vehicle 20 including a plurality of signaling devices schematically shown at 22. In some examples, the signaling devices 22 are configured as radar signaling devices useful for detecting objects in a vicinity of the vehicle 20 based on signals transmitted by the devices 22. The example signaling devices 22 may be useful for parking assistance, collision avoidance and other object detection features on a passenger vehicle.

Figure 2:
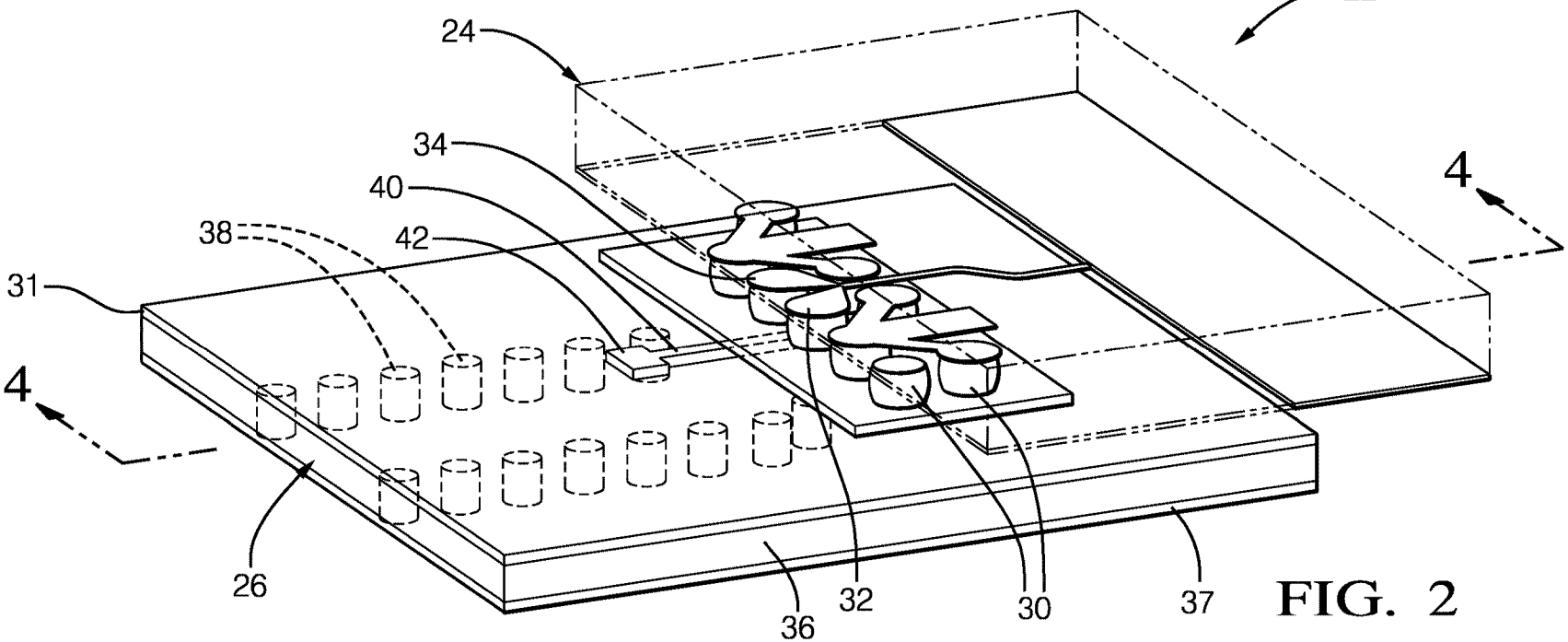
FIG. 2 diagrammatically illustrates a signaling device designed according to an embodiment of this invention.
Figure 3:
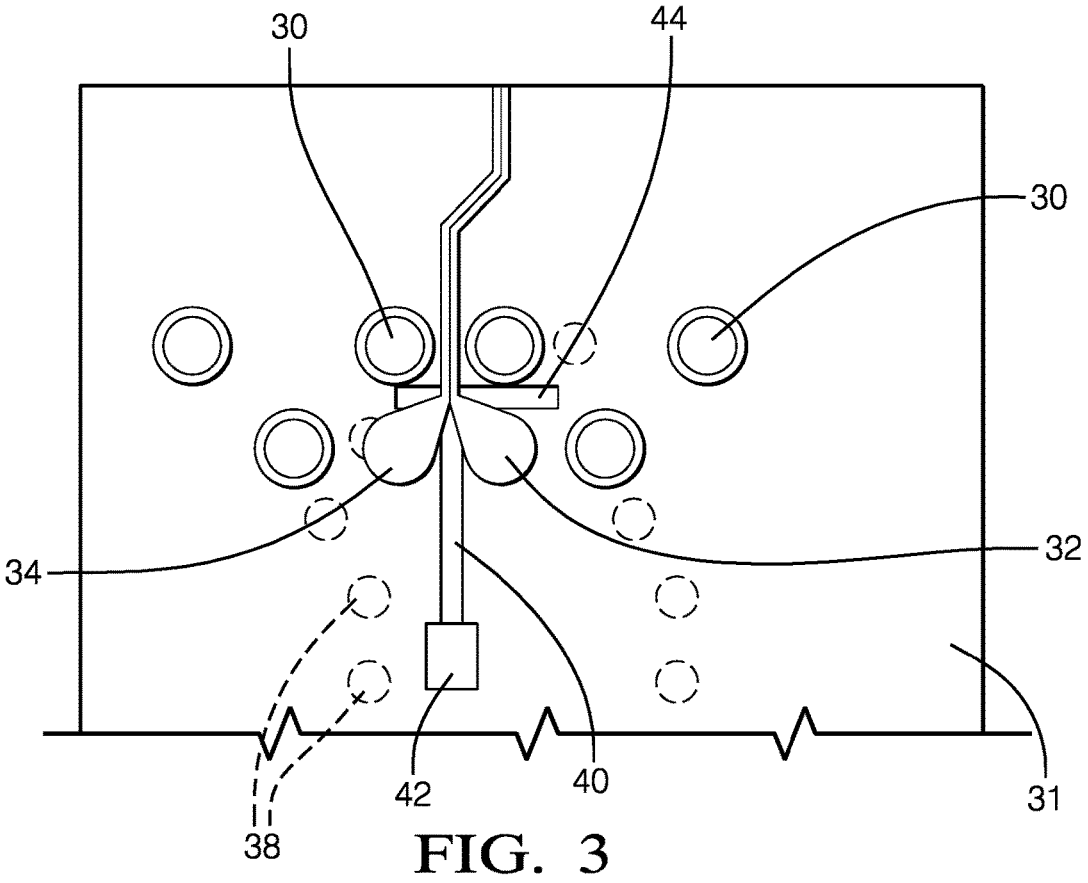
FIG. 3 shows selected features of the embodiment of FIG. 2.
Figure 4:
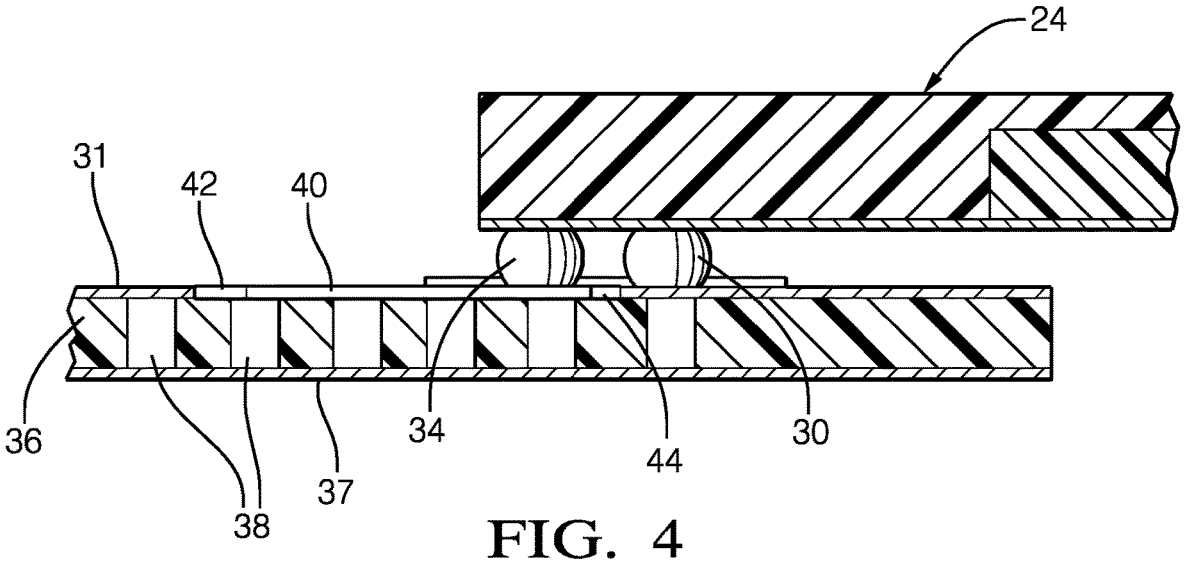
FIG. 4 is a sectional illustration taken along the lines 4-4 in FIG. 2.

As shown in FIGS. 2 through 4, an embodiment of the signaling devices 22 includes a signal generator 24 and a substrate-integrated-waveguide (SIW) 26. The signal generator 24 includes a plurality of solder balls 30 that are secured to a metal layer 31 on one surface or side of the SIW 26. The signal generator 24 includes at least one conductive signal output member. The illustrated example embodiment includes conductive signal output members 32 and 34. Two signal output members allow for the output of the signal generator 24 to be a differential signal. The signal output members 32 and 34 comprise solder balls. The circuitry that generates the signal is not shown and may comprises known radar signal generating circuitry or components.

The SIW 26 includes a substrate 36, which may comprise a known dielectric material. The substrate 36 has the metal layer 31 on the one side and a metal layer 37 on an opposite side. The metal layers 31 and 37 comprise copper in some embodiments.

A plurality of conductors 38 are situated in the substrate 36 to establish the waveguide of the SIW. The conductors 38 may comprise open or filled vias between the metal layers 31 and 37, for example. The arrangement of the conductors 38 in the illustrated example is consistent with via arrangements in known SIW configurations.

The SIW 26 includes a slot 40 in an exterior surface for coupling the signal of the signal generator 24 into the SIW 26. The slot 40 has a depth that extends through the metal layer 31. A length of the slot 40, which is parallel to a length of the SIW, corresponds to one-half of the wavelength of the signal produced by the signal generator 24. Such a slot length need not be, and in many embodiments will not be, exactly the same as one-half of the signal wavelength. Instead, a slot length that corresponds to a one-half wavelength will be tuned or adjusted slightly to achieve a desired performance. In one example embodiment that includes an 85 GHz signal, the wavelength is about 2 mm in the dielectric material of the substrate 36 because that material has a dielectric constant of about 3. The length of the slot 40 in the example embodiment is about 1 mm. Such a slot length facilitates an ultra-wideband transition into the SIW 26. Signal devices including a slot designed like that in the illustrated example embodiment are useful with signal frequencies between 65 GHz and 90 GHz.

A width of the slot 40 is approximately equal to a spacing between the conductive signal output members 32 and 34. In the illustrated example the width of the slot 40 is at least 0.1 mm and no wider than the spacing between the conductive signal output members 32 and 34. The slot width in some embodiments is based on the spacing between the soldered material of the signal output members 32 and 34 after soldering.

A stub 42 at one end of the slot 40 comprises an opening through the metal layer 31 that is wider and shorter than the slot 40. The stub 42 effectively provides additional resonance at lower frequencies and extends the resonance provided by the slot 40. The stub 42 contributes to establishing an ultra-wideband transition into the SIW 26.

A portion of the slot 40 is situated between the signal output members 32 and 34 as best seen in FIG. 3. A transverse slot 44 is situated at the end of the slot 40 that is closer to the signal output members 32 and 34 and opposite the end of the slot 40 that includes the stub 42. The transverse slot 44 is situated behind the signal output members 32 and 34 using the direction of signal propagation through the SIW 26 as a reference. The transverse slot 44 effectively enlarges the resonance bandwidth of the slot 40.

The transverse slot 44 in the illustrated example has a length that is perpendicular to the length of the slot 40. A perpendicular arrangement of the slots 40 and 44 minimizes mutual coupling in the respective electric fields of the slots. The electric field of the transverse slot 44 is perpendicular to the electric field of the slot 40. The length of the transverse slot 44 is selected based on the dimensions or placement of the conductive signal output members 32 and 34. The length of the transverse slot 44 in some embodiments is no wider than the spacing between the conductive vias 38 near the transverse slot 44 and no less than a center-to-center distance between the signal output members 32 and 34.

In some example embodiments, the slot 40, the stub 42 and the transverse slot 44 are formed in the metal layer 31 by etching away some of the metal.

One feature of the example device configuration is that multiple slots 40 corresponding to respective signal generator output members can be supported on the same substrate. The isolation between adjacent SIWs with slots 40 may be on the order of −34 dB. Being able to include multiple signal sources and multiple SIWs on a single substrate can facilitate a wider variety of device capabilities within tighter packaging constraints.

The slot 40 couples energy from the signal output members 32 and 34 directly into the SIW 26 without any high transition loss. The slot 40 with the transverse slot 44 and the stub 42 provide an ultra-wideband transition. Additionally, the slot 40 is useful with differential signals, which microstrip lines cannot handle as those are limited to handling single-ended signals. Embodiments of this invention are suitable for a variety of signaling or detecting devices even though a vehicle radar detector is given as an example for discussion purposes.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An electronic device, comprising:

a signal generator having at least one conductive output member; and a substrate integrated waveguide (SIW) comprising a substrate and a plurality of conductive members in the substrate, the substrate including a slot in one exterior surface of the substrate and a stub near an end of the slot, the stub having a stub width that is wider than a width of the slot and a stub length that is shorter than a length of the slot, the slot being situated adjacent to the at least one conductive output member of the signal generator such that a signal of the signal generator is coupled into the SIW through the slot.

2. The device of claim 1, wherein the at least one conductive output member comprises two output members; and a portion of the slot is situated between the two output members.

3. The device of claim 2, wherein the signal of the signal generator comprises a differential signal.

4. The device of claim 2, wherein the two output members respectively comprise a solder ball.

5. The device of claim 1, wherein the SIW has a length that corresponds to a direction of signal propagation along the SIW;

the slot has a length that is parallel to the SIW length; and the length of the slot corresponds to one-half a wavelength of a signal produced by the signal generator.

6. The device of claim 1, wherein the substrate includes a second slot near one end of the slot; and the second slot is transverse to the slot.

7. The device of claim 6, wherein the second slot is perpendicular to the slot.

8. The device of claim 7, wherein the at least one conductive output member is between the second slot and another end of the slot.

9. The device of claim 6, wherein the at least one conductive output member comprises two output members;

the second slot has a length; and the length of the second slot is at least as long as a center-to-center spacing between the two output members.

10. The device of claim 1, wherein the slot and the stub comprise openings through the exterior surface of the substrate.

11. The device of claim 10, wherein the exterior surface of the substrate comprises an electrically conductive metal.

12. An electronic device, comprising:

a signal generator having at least one conductive output member; and a substrate integrated waveguide (SIW) comprising a substrate and a plurality of conductive members in the substrate, the substrate including a slot in one exterior surface of the substrate, the slot being situated adjacent to the at least one conductive output member of the signal generator such that a signal of the signal generator is coupled into the SIW through the slot, wherein the exterior surface includes a transverse slot near a first end of the slot;

the exterior surface includes a stub near a second end of the slot;

the at least one conductive output member is closer to the first end of the slot than the second end of the slot; and the transverse slot is situated on an opposite side of the at least one conductive output member from the stub.

13. The device of claim 12, wherein the at least one conductive output member comprises two output members;

the two output members have a spacing between them;

a portion of the slot is situated within the spacing between the two output members.

14. The device of claim 13, wherein a width of the slot is less than the spacing.

15. An electronic device, comprising:

a signal generator including two conductive output members; and a substrate integrated waveguide (SIW) comprising a substrate and a plurality of conductors in the substrate, wherein the substrate includes a slot in an exterior surface of the substrate, the slot is situated on the exterior surface with a portion of the slot situated between the two conductive output members of the signal generator such that a signal of the signal generator is coupled into the SIW through the slot, the substrate includes a stub at one end of the slot, the stub comprises an opening through the exterior surface that is wider and shorter than the slot, the substrate includes a second slot near an end of the slot opposite from the one end, the second slot is transverse to the slot, and the portion of the slot and the two conductive output members are between the second slot and the stub.

16. The device of claim 15, wherein the signal of the signal generator comprises a differential signal.

17. The device of claim 15, wherein the two output members respectively comprise a solder ball.

18. The device of claim 15, wherein the SIW has a length that corresponds to a direction of signal propagation along the SIW;

the slot has a length that is parallel to the SIW length; and the length of the slot corresponds to one-half a wavelength of a signal produced by the signal generator.

19. The device of claim 15, wherein the second slot is perpendicular to the slot.

* * * * *